United States Patent [19]

Mogi

[11] Patent Number: 4,736,226

[45] Date of Patent: Apr. 5, 1988

[54] FIXING DEVICE

[75] Inventor: Michio Mogi, Hachioji, Japan

[73] Assignee: Konishiroku Photo Industry Co., Ltd., Tokyo, Japan

[21] Appl. No.: 804,285

[22] Filed: Dec. 3, 1985

[30] Foreign Application Priority Data

Dec. 5, 1984 [JP] Japan ..... 59-258111

[51] Int. Cl.[4] ..... G03G 15/20

[52] U.S. Cl. ..... 355/3 FU; 219/216; 219/469

[58] Field of Search ..... 355/3 FU; 219/216, 469, 219/470, 471; 432/60

[56] References Cited

U.S. PATENT DOCUMENTS

| | | | |
|---|---|---|---|
| 3,331,592 | 7/1967 | Cassano et al. | 355/3 FU |
| 4,154,575 | 5/1979 | Edwards et al. | 355/3 FU X |
| 4,538,052 | 8/1985 | Asanuma et al. | 219/469 |
| 4,551,006 | 11/1985 | Elvin | 355/3 FU X |

FOREIGN PATENT DOCUMENTS

| | | | |
|---|---|---|---|
| 53-64526 | 9/1978 | Japan | 355/3 FU |
| 57-74769 | 5/1982 | Japan | 355/3 FU |
| 57-114168 | 7/1982 | Japan | 355/3 FU |
| 58-169168 | 10/1983 | Japan | 355/3 FU |

*Primary Examiner*—Arthur T. Grimley
*Assistant Examiner*—J. Pendegrass
*Attorney, Agent, or Firm*—Jordan B. Bierman

[57] ABSTRACT

A fixing device including a fixing roller and a pressure member rotatable in pressure-contact with said fixing roller, out of which at least one is provided with a heater and is capable of fixing an image-recorded material bearing thereon, toner is passed through between said fixing roller and said pressure member; said fixing device characterized in that at least one of said heaters is made in the bar-like form and served as a supporting shaft for rotating said fixing roller or said pressure member and can further be taken out and put in.

15 Claims, 3 Drawing Sheets

FIXING DEVICE

BACKGROUND OF THE INVENTION

This invention relates to an improvement of a fixing device used in an image recording apparatus.

Heretofore, the roller-unit of a roller type fixing device has been so constructed that the supporting shaft and the roller have been constructed unitedly in a body and a heater lamp such as a halogen lamp has been inserted thereinside.

In the above-mentioned construction, there is such a problem, when disassembling or assembling the fixing devices for the purposes of rendering a maintenance and the like, as that the roller unit cannot be detached unless the roller unit constructed unitedly in a body is disassembled, so that it will take a time and skill to disassamble and assemble the roller unit and any effective maintenance may not be performed.

Though there have been proposed to try to improve the disassembling, assembling and maintenance by making use of a sheath-type heater or the like as a heater, there have still been various problems so that nothing has been put in practical use. This invention is to solve such problems as mentioned above.

OBJECT AND SUMMARY OF THE INVENTION

It is an object of the invention to provide a fixing device capable of solving the above-mentioned problems.

The above-mentioned object can be achieved by a fixing device comprising a fixing roller and a pressure member rotatable in pressure-contact with the fixing roller, out of which at least one is provided with a heater and capable of fixing an image-recorded material bearing thereon toners is passed through between the fixing roller and the pressure member; such fixing device characterized in that at least one of the heaters is made in the bar-like form and served as a supporting shaft for rotating the fixing roller or the pressure member, and can further be taken out from and put in to the roller. The heater preferably comprises an outer metal cylinder and a heat generator.

DESCRIPTION OF THE PREFERRED EMBODIMENTS

Figure 1A:
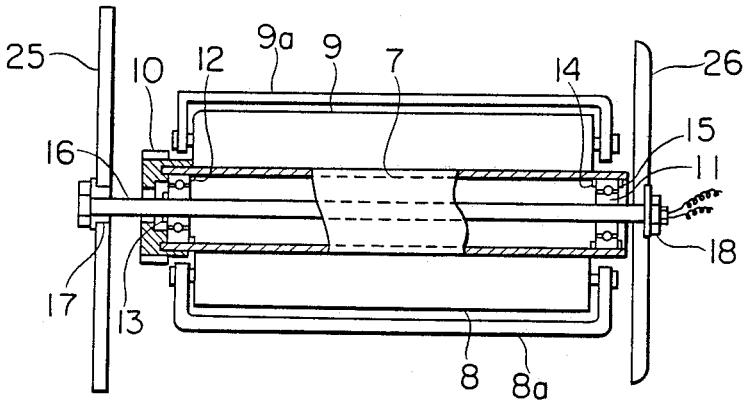
FIG. 1*a* illustrates a cross-sectional view of the first example of the fixing devices of the invention.
Figure 2:
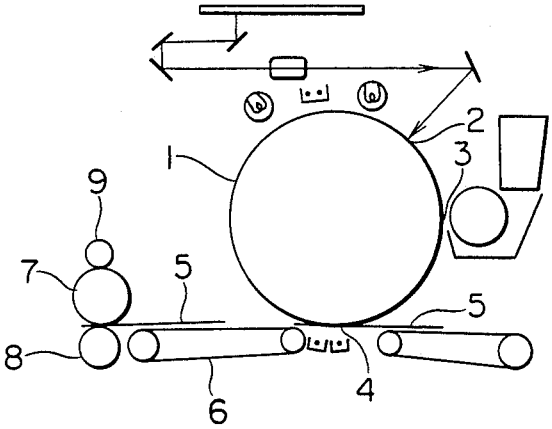
FIG. 2 is a schematic construction of an image recording apparatus.

FIG. 1*a* illustrates an example of the fixing devices of the invention; and FIG. 2 illustrates an example of the image recording apparatuses incorporated thereinto with the fixing device of the invention illustrated in FIG. 1*a*.

Generally in an image recording apparatus as shown in FIG. 2, a latent image formed on a photoreceptor 1 in an exposure position 2 is made visible with toners in a developing position 3 and the visible image is transferred onto an image transfer paper 5 in a transferring position 4 and is further introduced by a conveyor belt 6 into a fixing roller 7 to be fixed there so that an image recording may be completed in such a form as a copy or the like so as to come to hand. In this type of fixing devices, a heat-roller type fixing system is usually used, and wherein such a fixing roller directly comes into contact with the toner-transfer surface of a transfer paper to hot-melt the toners so as to fix the toners onto the transfer paper. In this case, the roller surface is coated with fluoreresin or the like, for example, so as not to peel off the toners from the transfer paper but to easily release the fixing roller from such a toner material. On the other hand, a pressure roller 8 which is lined around the outer surface thereof with silicone rubber A, which is the same as that shown in FIG. 4, having a thickness of about 5 mm is pressed to the fixing roller at about 1.5 kg/cm, and the transfer paper is sandwiched in between both rollers and is conveyed with being fixed. It is the matter of course that the pressure member is allowed to be a pressure belt instead of the pressure roller, and the fixing effect can be obtained. In addition, a cleaning roller is also brought into contact with the fixing roller at almost the same pressure to wipe off a small amount of toners adhered to the fixing roller.

Heaters to be used therein include, for example, the so-called cartridge-heaters, pipe-heaters or heat-pipes. The materials to be used for the pipes include, for example, such a heat-resistive and shock-resistive substance as a metal, e.g., copper, iron, aluminium, steel, stainless-steel and the like, or ceramics. The resistance wires for a heat-generator to be used therein include, for example, a nickel-chrome wires, a copper-chrome wire or the like. As for the examples of such heaters, 'Fire-Rod' (a trade name) cartridge-heater (manufactured by Watlow Co.) and a red-heat-sheathe heater (manufactured by Japan Heater Co.) may be given.

These heaters have a considerable strength to serve as the shaft members of a machinery. In this invention, therefore, these heaters are positively used as the shaft members. One of the examples thereof is illustrated in FIG. 1*a*. Wherein, fixing roller 7 coated thereon with a releasing layer made of, for example, fluororesin is inserted through bearings 11 and retaining-rings 12, 13, 14, 15 with pipe-heater 16 to serve as a revolvable supporting shaft, and gear 10 of a driving member is mounted to an end of the pipe-heater 16, and both ends of the pipe-heater 16 are fixed, through bush 17 and nut 18, to frames 25, and 26 located on the both sides of the pipe-heater, respectively. Thereinto, pressure roller 8 and the bracket 8*a* thereof and cleaning roller 9 and the bracket 9*a* thereof are incorporated, respectively, so that a fixing device may be constructed.

Figure 1B:
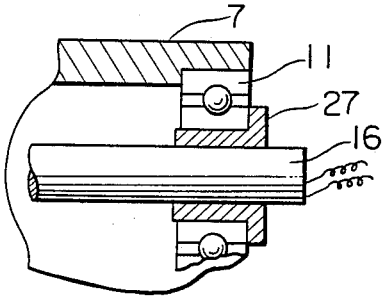
FIG. 1*b* is a descriptive illustration of an example of the countermeasures for heat-insulation effects.
Figure 1C:
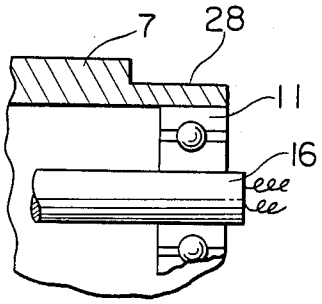
FIG. 1*c* is a descriptive illustration of another example of the countermeasures for heat-insulation effects.

Next, as the second example is shown in FIG. 1*b*, it is allowed to interpose heat-insulators 27; and as shown in FIG. 1*c* it is also effective to make notch 28 on the outer peripheral surface of the fixing roller in the portion where the bearings are fitted in a heat-conductive section. The heat-insulating materials to be used therein include, for example, such a heat-resistive resin as a silicone resin, a thermosetting polyimide resin, a polyphenylene sulfide or the like.

Further, a description will now be made about an example of fixing devices in which pipe-heater 16 is incorporated into a pressure-roller.

Figure 3:
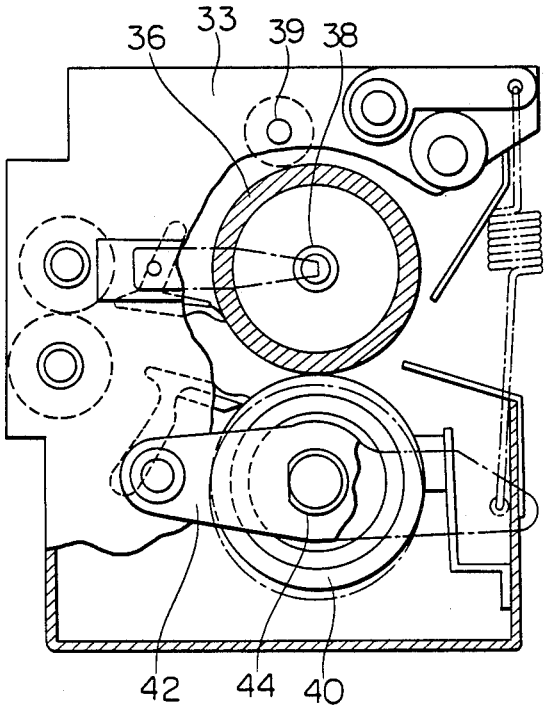
FIG. 3 is a front view of a partial cross-section showing a further example of the fixing devices.
Figure 4:
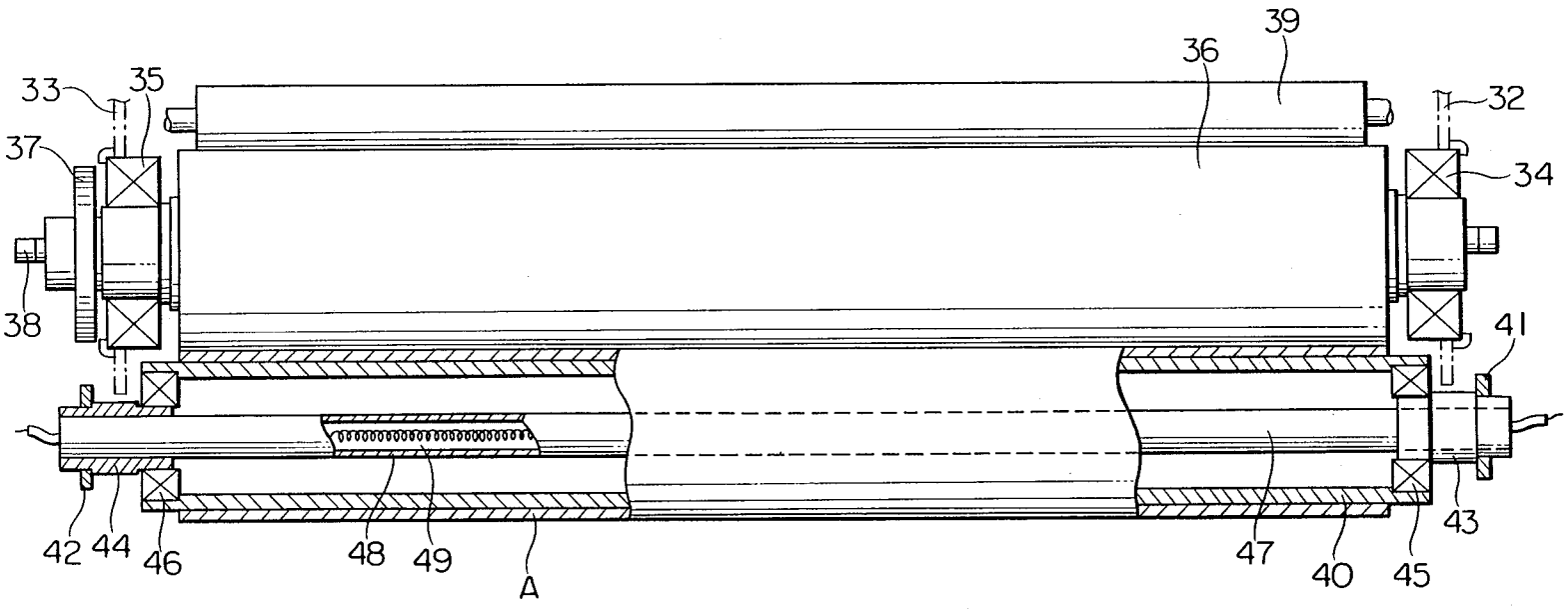
FIG. 4 illustrates a side view of the fixing roller and the pressure roller of the example illustrated in FIG. 3.

As shown in FIG. 4, the main frame of the fixing device comprises side plates 32, 33, and fixing roller 36 is so provided as to be supported the both ends thereof by bearings 34, 35 arranged to a part of each of the side plates, and further fixing roller 36 is attached with driving gear 37 in a body. 38 is an infrared lamp for heating the fixing roller and is so arranged to the inside through of the fixing roller and to be kept in position by suitable supporting members. In addition, a fluororesin layer is provided onto the surface of the fixing roller with the purpose of preventing toner adhesion which may occur in the course of fixation, so that the releasability can be improved. 39 is a cleaning roller for cleaning the fixing roller. 40 is a pressure roller for pressuring the fixing roller 36 from the lower part of the fixing roller 36. This pressure roller 40 is held on the outside of the side plates 32, 33 through a one-end pivotteable swingable levers 41, 42, receiving members 43, 44 and bearings 45, 46 as shown in FIGS. 3 and 4, and a pipe-heater 47 whose whole outer surface is finished without any difference in level is inserted through the inside of the receiving members 43, 44 to be unitedly in a body. The pipe-heater is made of such a heat-resistive and shock-resistive metal as stainless-steel or the like, and there are a built-in heater 48 and filling material 49 inside thereof. The structure of this fixing roller is almost the same as that of the fixing roller embodied and shown in FIG. 1*a*. On the other hand, however, in the case of the pressure roller, it is very essential from the viewpoint of maintaining a copying machine that such pressure roller may easily and rapidly be detached and attached, because a smooth conveyance may not be performed by such a damage of silicone rubber A as a stain or the like of toners caused on the surface of the pressure roller, and the parts thereof have to be replaced very often. Pressure roller 40 may be detached in such a manner that, when pipe-heater 47 is pulled out from receiving members 43, 44, the state of holding pipe-heater 47 is cleared, and when either one of swingable levers 41 and 42 is slightly loosened from side plates 32, 33, receiving members 43, 44, bearings 45, 46 and pressure roller 40 are detached altogether at a time. On the other hand, the attachment thereof may be completed in such a manner that, as described above, receiving member 43, 44 are attached to swingable levers 41, 42, respectively, and pressure roller 40 together with bearings 45, 46 are attached first and then pipe-heater 47 is inserted through the inside of receiving member 43, 44. When such pipe-heater 47 is used in a pressure roller, a temperature of pipe-heater itself is not necessarily raised so high, because the pipe-heater is used for an auxiliary heater for fixation. The temperature of pipe-heater itself is set 350° C., the surface temperature of the central portion of pressure roller 40 is set to 110° C. and the both ends thereof is set to 100° C. so as to prevent the temperature of fixing roller 36 from lowering.

Accordingly, this example of the invention is effective in preventing an under-fixation especially in a high-speed copying operation, and a continuous copying and a warming-up in winter time may be shortened.

In FIG. 1, lead-wires are arranged to only one end of the heater to electrically connect to the heater, and in FIG. 4, they are arranged to both ends of the heater. Comparing with each other case, the wiring, disassembling and assembling services may easily be carried out by arranging them only to one end of the heater, as shown in FIG. 1.

According to the construction of the invention described above, the fixing device can be attached and detached in a very simple operation, because rollers together with bearings can be separated at once from a shaft when a pipe-heater, i.e., bar-type heaters 16, 47 are pulled out.

According to the preferred embodiments of the invention, the rollers can be made of straight pipes instead of the rollers provided with conventional flanges, because the bearing sections 11, 34, 35, 45, 46 are arranged to the inside of the rollers. It is, therefore, possible to reduce the processing costs of rollers and, in its turn, to reduce the costs of fixing device units.

What is claimed is:

1. A fixing device comprising a fixing roller, a rotatable pressure member in pressure contact with said fixing roller, at least one of said roller and said member having a primary heater adapted to heat an image-recording material which passes between said roller and said member, said primary heater being substantially bar-shaped and having at least its ends of circular cross-section, said ends mounted in bearings, said bearings disposed between said heater and said roller or said member, said heater being detachable from and rotatably supporting said roller or said member.

2. The device of claim 1 wherein said primary heater is in said roller and there is a secondary heater in said member.

3. The device of claim 1 wherein said heater comprises an outer cylinder and a heat generator within said cylinder.

4. The device of claim 3 wherein said cylinder is metal.

5. The device of claim 1 wherein lead wires electrically connecting said heater to a heat generator are attached at only one of said ends.

6. The device of claim 1 wherein heat insulating material is interposed between said heater and said bearing.

7. The device of claim 1 wherein there is a first position in which said roller and said member are in pressure contact with each other and a second position wherein said roller and said member are not in pressure contact, said heater being releasable from said roller or said member only in said second position.

8. The device of claim 1 wherein said heater is in said roller.

9. The device of claim 1 wherein said heater is in said member.

10. A fixing device comprising a fixing roller having a first heater, a rotatable pressure roller in pressure contact with said fixing roller, a second heater inserted through said pressure roller, said second heater being detachable from and incorporated in a receiving member, said second heater and said receiving member being fixed, said receiving member being held by a swingable lever, a bearing between said second heater and said pressure roller and between said receiving member and said pressure roller, said receiving member rotatably supporting said pressure roller through said bearing.

11. The device of claim 10 wherein said heater comprises an outer cylinder and a heat generator within said cylinder.

12. The device of claim 11 wherein said cylinder is metal.

13. The device of claim 10 wherein lead wires electrically connecting said heater to a heat generator are attached at only one of said ends.

14. The device of claim 10 wherein heat insulating material is interposed between said heater and said bearing.

15. The device of claim 10 wherein there is a first position in which said roller and said member are in pressure contact with each other and a second position wherein said roller and said member are not in pressure contact, said heater being releasable from said roller or said member only in said second position.

* * * * *